US008565622B2

(12) United States Patent
Yoshida et al.

(10) Patent No.: US 8,565,622 B2
(45) Date of Patent: Oct. 22, 2013

(54) IMAGE FORMING DEVICE AND METHOD FOR IDENTIFYING POSITIONS OF IMAGE FORMATION SECTIONS IN AN IMAGE FORMING DEVICE

(75) Inventors: Takayuki Yoshida, Saitama (JP); Mamoru Inoue, Saitama (JP); Hiroshi Hayashi, Saitama (JP); Atsushi Abe, Saitama (JP); Kazutaka Shibano, Saitama (JP); Masaaki Taki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 552 days.

(21) Appl. No.: 12/552,616

(22) Filed: Sep. 2, 2009

(65) Prior Publication Data

US 2010/0215382 A1 Aug. 26, 2010

(30) Foreign Application Priority Data

Feb. 26, 2009 (JP) ..... 2009-044123

(51) Int. Cl.
*G03G 15/00* (2006.01)

(52) U.S. Cl.
USPC ..... 399/12; 399/72; 399/177

(58) Field of Classification Search
USPC ..... 399/12, 72, 299, 177
See application file for complete search history.

(56) References Cited

U.S. PATENT DOCUMENTS 5,612,767 A * 3/1997 Iwama ..... 399/98
6,308,018 B1 10/2001 Yoshida et al.
6,408,141 B1 * 6/2002 Tahara ..... 399/12
7,054,567 B2 * 5/2006 Furno et al. ..... 399/38
2003/0214568 A1 * 11/2003 Nishikawa et al. ..... 347/116
2004/0033090 A1 * 2/2004 Yamanaka et al. ..... 399/301
2005/0104950 A1 * 5/2005 Eom ..... 347/116

FOREIGN PATENT DOCUMENTS

JP A-2000-206832 7/2000
JP A-2001-125335 5/2001
JP A-2001-215772 8/2001
JP A-2005-134592 5/2005
JP A-2005-165187 6/2005
JP A-2006-220704 8/2006

* cited by examiner

*Primary Examiner* — Walter L Lindsay, Jr.
*Assistant Examiner* — Benjamin Schmitt
(74) *Attorney, Agent, or Firm* — Oliff & Berridge, PLC

(57) ABSTRACT

The present invention provides an image forming device including: plural image formation sections, a second exposure section, a transfer body, a reading section and an identification section. Each image formation section includes a control section that controls a first exposure section to form an identification image of a color represented by color information in accordance with an image formation instruction. The second exposure section performs exposure onto a charged image-bearing body and forms an electrostatic latent image. An image is formed at the transfer body. The reading section reads an image. The identification section outputs to the plurality of image formation sections an image formation instruction and, on the basis of a duration from the output until the identification image is read by the reading section, identifies a position of the image formation section forming the image of the color instructed by the image formation instruction.

9 Claims, 10 Drawing Sheets

IMAGE FORMING DEVICE AND METHOD FOR IDENTIFYING POSITIONS OF IMAGE FORMATION SECTIONS IN AN IMAGE FORMING DEVICE

CROSS-REFERENCE TO RELATED APPLICATION

This application is based on and claims priority under 35 USC 119 from Japanese Patent Application No. 2009-044123 filed Feb. 26, 2009.

BACKGROUND

Technical Field

The present invention relates to an image forming device and a method for identifying positions of image formation sections in an image forming device.

SUMMARY

According to an aspect of the invention, there is provided an image forming device including: a plurality of image formation sections, each of which is capable of forming images of a pre-specified color, each image formation section comprising, a memory that stores a color information representing the color of images formable by the image forming section, an image-bearing body, a charging section that charges the image-bearing body to a pre-specified potential, a first exposure section that performs exposure onto the image-bearing body and forms an electrostatic latent image representing a pre-specified identification image on the image-bearing body, a developing section that develops the electrostatic latent image, and a control section that controls the first exposure section to form the identification image in accordance with an image formation instruction that instructs that the identification image be formed of the color represented by the color information; a second exposure section that performs exposure onto the image-bearing bodies at the plurality of image formation sections and causes electrostatic latent images representing images to be formed on the image-bearing bodies; a transfer body at which an image is formed by the image formation sections; a reading section that reads the identification images; and an identification section that outputs to the plurality of image formation sections an image formation instruction instructing formation of the identification image of at least one color of the colors formable by the plurality of image formation sections and that, on the basis of a duration from the output until the identification image is read by the reading section, identifies a position of the image formation section forming the image of the color instructed by the image formation instruction.

BRIEF DESCRIPTION OF THE DRAWINGS

Exemplary embodiments of the present invention will be described in detail based on the following figures, wherein.

DETAILED DESCRIPTION

Herebelow, an example of an exemplary embodiment of the present invention will be described in detail with reference to the drawings.

Figure 1:
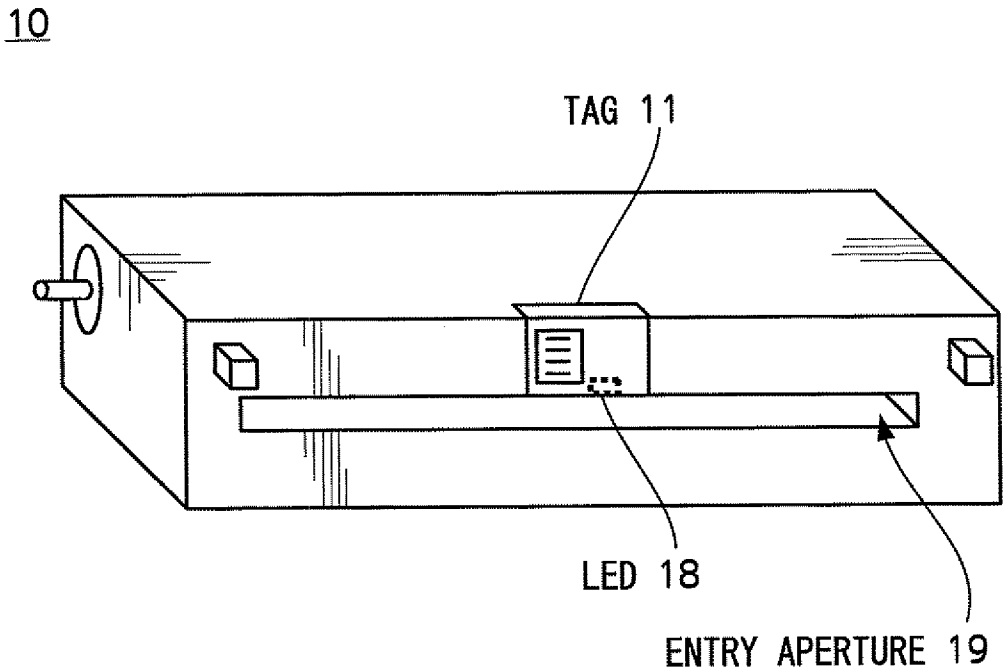
FIG. 1 is a perspective view of a removable developing device relating to an exemplary embodiment.

Firstly, an image formation section relating to the present exemplary embodiment (hereinafter referred to as a removable developing device) is described using FIG. 1. FIG. 1 is a perspective view of a removable developing device 10. As shown in FIG. 1, a tag 11 including an LED (light emitting diode) 18 is provided at the removable developing device 10. An entry aperture 19 for incidence of light from an exposure device, which will be described later, is provided in the removable developing device 10.

Figure 2:
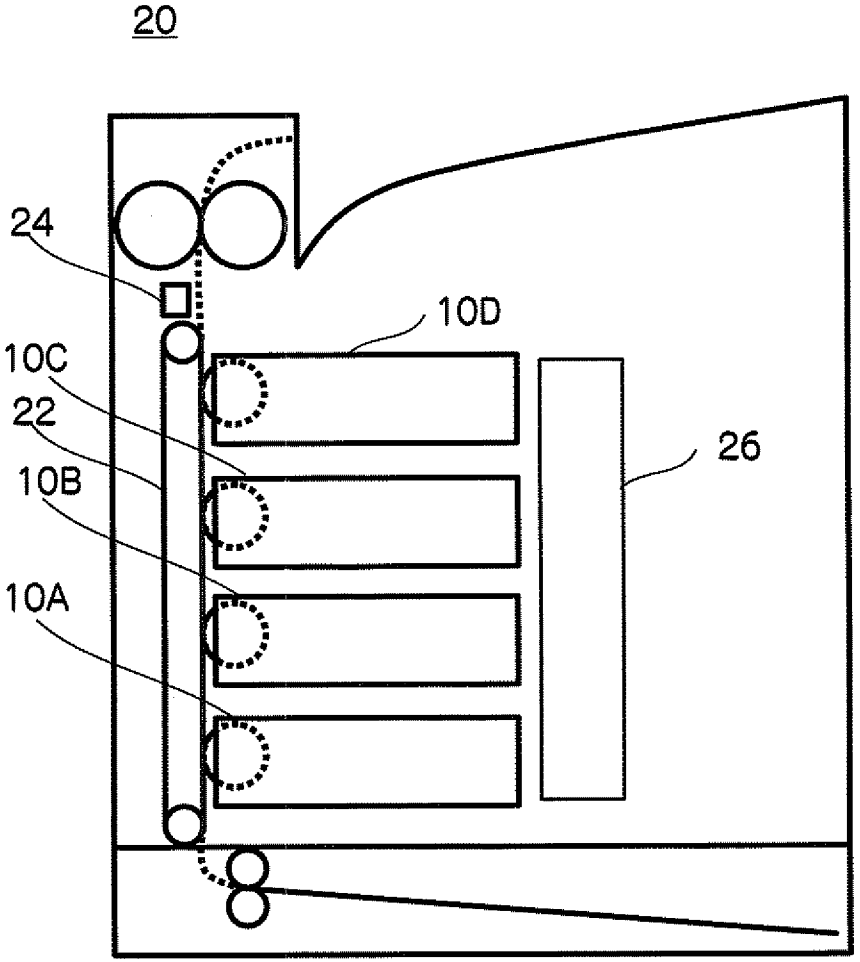
FIG. 2 is a cross-sectional view of an image forming device relating to the exemplary embodiment.

The removable developing device 10 forms an image of a pre-specified color. Accordingly, in a case of an image forming device capable of color printing, the removable developing device 10 is plurally provided, as illustrated in FIG. 2. FIG. 2 is a sectional view of an image forming device 20. As shown in FIG. 2, plural (four in the drawing) removable developing devices 10A, 10B, 10C and 10D are installed. In the descriptions herebelow, when the four removable developing devices are not to be particularly distinguished, they are simply referred to as the removable developing device(s) 10. An exposure device 26 (a second exposure section) is also provided in the image forming device 20. The exposure device 26 (second exposure section) performs exposure onto image-bearing bodies that are charged up by chargers, which will be described later, at the plural removable developing devices 10, and forms electrostatic latent images representing an image on the image-bearing bodies.

The four removable developing devices 1O correspond to the colors CMYK (the colors cyan, magenta, yellow and key). As the image forming device 20 has a plural number of the removable developing devices 10, the image forming device 20 has four installation positions for installing the removable developing devices 10, as shown in FIG. 2. In the image forming device 20 relating to the present exemplary embodiment, arbitrary colors of the removable developing devices 10 may be installed at the installation positions.

Further, a transfer body 22 for transferring images from the removable developing devices 10 is provided in the image forming device 20. A patch detection sensor 24, which serves as a reading section that reads an image formed at the transfer body 22, is also provided in the image forming device 20. As specific examples of this patch detection sensor 24, a density detection sensor, a sensor for detecting registration errors and the like may be applied.

Figure 3:
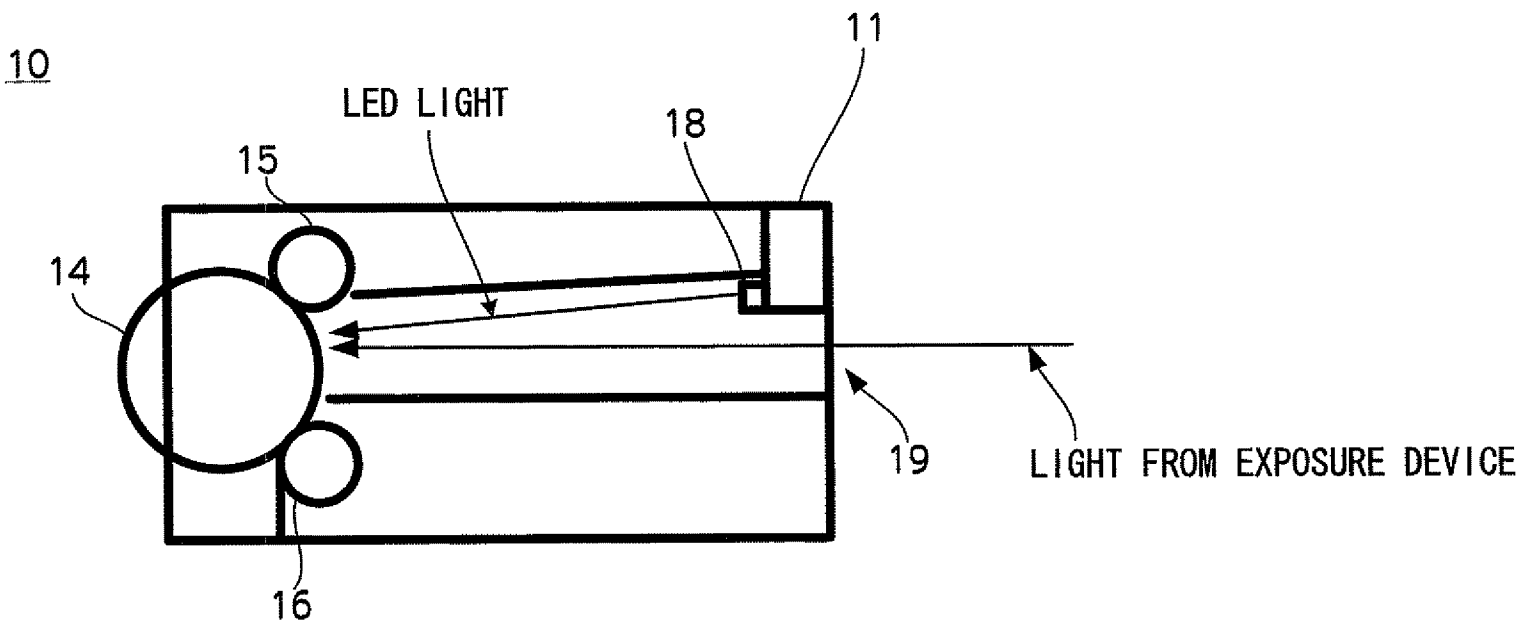
FIG. 3 is a cross-sectional view of the removable developing device relating to the exemplary embodiment.

Next, mechanical structures of the removable developing device 10 will be described using FIG. 3. FIG. 3 is a sectional view of the removable developing device 10. As illustrated in FIG. 3, the removable developing device 10 includes an image-bearing body 14, a charger 15, the LED 18 (a first exposure section), a developer 16 and the tag 11. The charger 15 charges the image-bearing body 14 up to a pre-specified potential. The LED 18 (first exposure section) performs exposure onto the image-bearing body 14 that has been charged up by the charger 15, and forms an electrostatic latent image that represents a pre-specified identification image (hereinafter referred to as a patch) on the image-bearing body 14. The developer 16 develops the electrostatic latent image formed on the image-bearing body 14 and forms the patch. The tag 11 forms a patch with the LED 18 in accordance with an image formation instruction (hereinafter referred to as a light emission instruction).

As shown in FIG. 3, the LED 18 is provided at the tag 11. The LED 18 is provided at a position from which it is possible to illuminate light at the image-bearing body 14. Herein, as shown in FIG. 3, light from the exposure device 26 is incident through the aforementioned entry aperture 19. A wavelength of light emitted by the LED 18 has the same as a wavelength of light emitted by the exposure device 26.

The image-bearing body 14, by touching against the transfer body 22, causes a developing agent to adhere to the transfer body 22. Due thereto, the image-bearing body 14 forms an image on the transfer body 22.

Figure 4C:
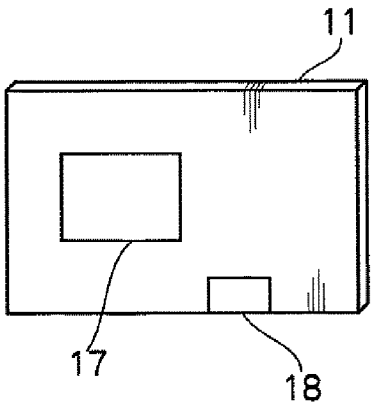
FIG. 4A to FIG. 4C are diagrams illustrating structure of the removable developing device.
Figure 4B:
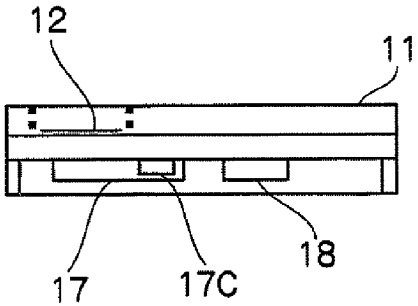
Figure 4A:
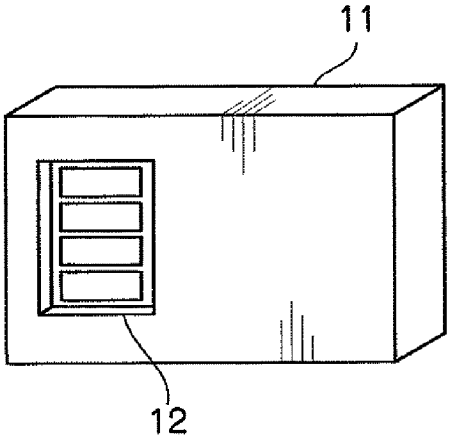

The tag 11 is described using FIG. 4A to FIG. 4C. FIG. 4A is a front perspective view of the tag 11. FIG. 4B is a plan view of the tag 11. FIG. 4C is a rear perspective view of the tag 11.

As shown in FIG. 4A, a terminal 12 is provided at the tag 11, for implementing exchanges of information with the image forming device 20. In the present exemplary embodiment, exchanges of information with the image forming device 20 use a wired system as illustrated in FIG. 4A, but may use a wireless system.

In FIG. 4B, a removable developing device control device 17 is illustrated. This removable developing device control device 17 is configured to include a memory device 17C. The removable developing device control device 17 controls the removable developing device 10 as a whole. Information representing a color that is formable by the removable developing device 10 is stored in the memory device 17C. The removable developing device control device 17 and the LED 18 are illustrated in FIG. 4C. As shown in FIG. 4C, the LED 18 is provided at an end of the tag 1.

Figure 5:
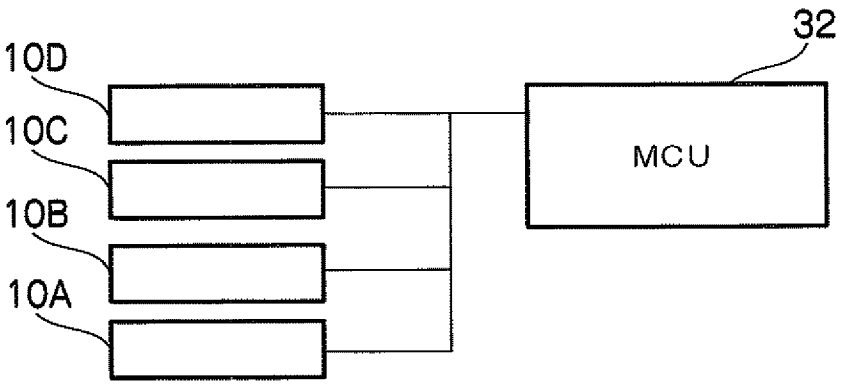
FIG. 5 is a diagram illustrating an example of electrical connections between the image forming device and each removable developing device.

Next, an example of electrical connections between the image forming device 20 and the removable developing device 10 is described using FIG. 5. Four of the removable developing device 10 and an MCU (microcontroller unit) 32 are shown in FIG. 5. The MCU 32 is provided at the image forming device 20.

The MCU 32 and the removable developing devices 10 are connected 1:N in the present exemplary embodiment (N=4 in the present exemplary embodiment). According to this structure, there is one transmission/reception circuit in the MCU 32 for communicating with the removable developing devices 10 in the present exemplary embodiment.

The MCU 32 outputs light emission instructions for forming patches of color for identification. A light emission instruction is received by each of the removable developing devices 10. The removable developing device control device 17 of each of the removable developing devices 10 receiving the instruction, in accordance with a light emission instruction for forming a patch of a color represented by the color information stored by the memory device 17C thereat, performs control to cause the LED 18 to emit light and form a patch by light emission from the LED 18.

Specifically, when the color represented by the light emission instruction is the same as the color represented by the color information stored in the memory device 17C, the removable developing device control device 17 controls to form a patch with the LED 18.

Next, for identifying which of the installed removable developing devices 10 is the removable developing device 10 of which color, an example of a patch is described. As mentioned earlier, removable developing devices 10 of arbitrary colors may be installed at the installation positions. In order to identify what colors of removable developing devices 10 are installed, the MCU 32 causes each removable developing device 10 to form a patch at the transfer body 22 as illustrated in FIG. 6.

Figure 6:
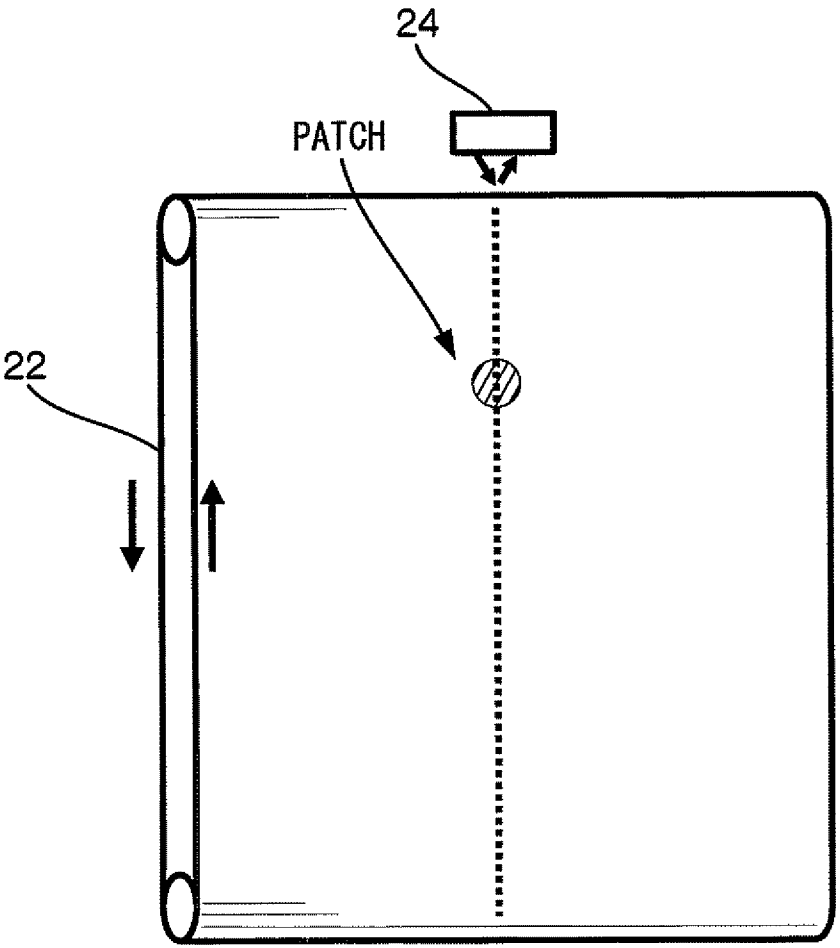
FIG. 6 is a diagram illustrating an example of a patch that is formed.

As shown in FIG. 6, the patch detection sensor 24 is formed at a position from which detection is possible. The dotted line shown on the transfer body 22 in FIG. 6 indicates a position that is detectable by the patch detection sensor 24. A patch that has been formed is moved in the direction of the arrows at a pre-specified speed by the transfer body 22, and reaches the position that is detectable by the patch detection sensor 24. Accordingly, a duration from the light emission instruction to the patch being detected differs in accordance with an installation position.

Figure 7:
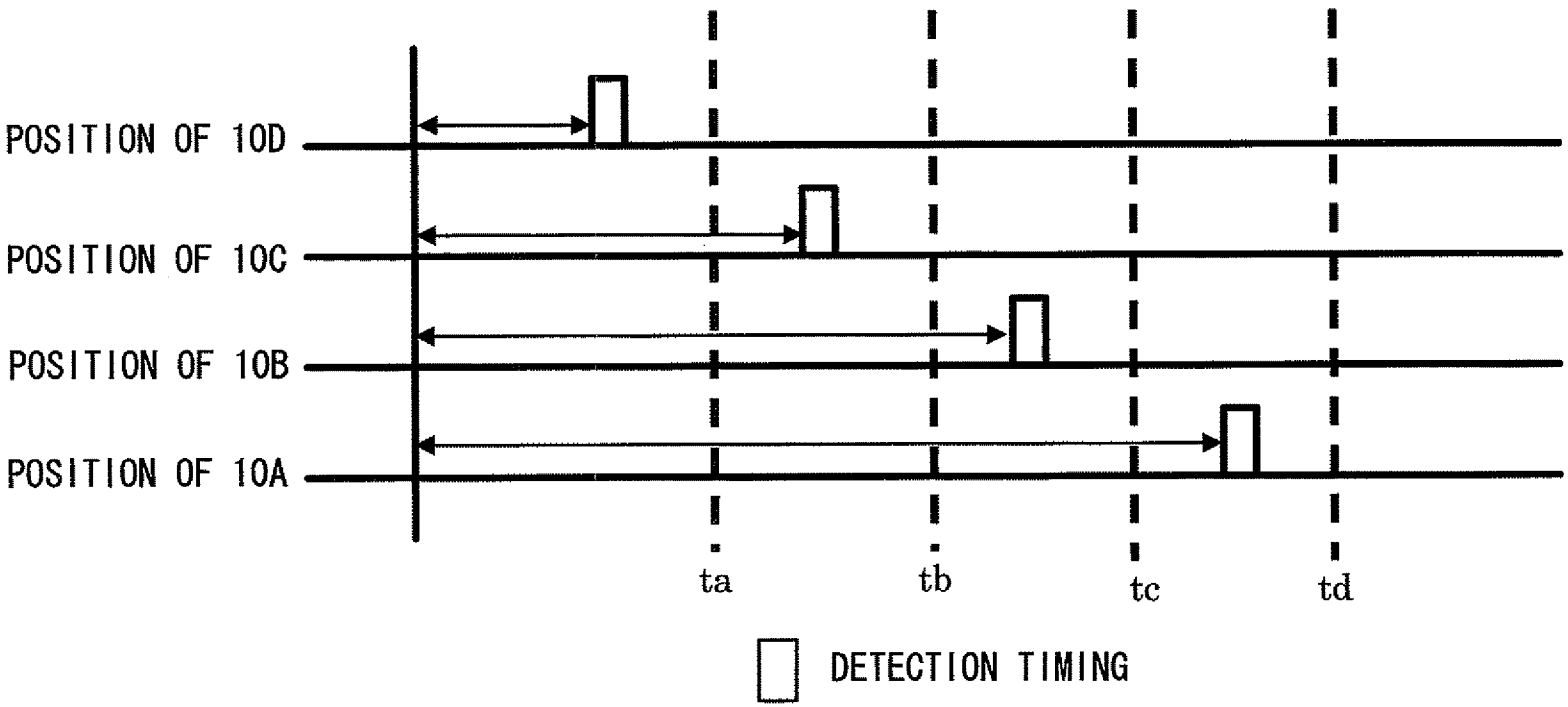
FIG. 7 is a diagram illustrating a relationship between time until a patch is detected and installation position.

The above is more specifically explained using FIG. 7. FIG. 7 is a diagram showing a relationship between the duration from the MCU 32 transmitting a light emission instruction, to the patch being detected by the patch detection sensor 24 and the installation position.

The vertical axis of FIG. 7 represents the positions of the removable developing devices 10A, 10B, 10C and 10D. The horizontal axis in FIG. 7 represents time. The movement speed of the transfer body 22 is a pre-specified speed, and the installation positions and the position detectable by the patch detection sensor 24 are respectively constant. Therefore, as illustrated in FIG. 7, a duration t from a light emission instruction to detection of a patch by the patch detection sensor 24 has the following relationships.

For the removable developing device 10D, $t \leq ta$

For the removable developing device 10C, $ta < t \leq tb$

For the removable developing device 10B, $tb < t \leq tc$

For the removable developing device 10A, $tc < t \leq td$

Accordingly, the MCU 32 outputs to the plural removable developing devices 10 a light emission instruction for forming the patch in one color of the colors that can be formed by the plural removable developing devices 10. Then, on the basis of the duration from outputting the light emission instruction to the patch being read by the patch detection sensor 24, the MCU 32 identifies the position of the removable developing device 10 that formed the patch of the color instructed by the light emission instruction.

Figure 8:
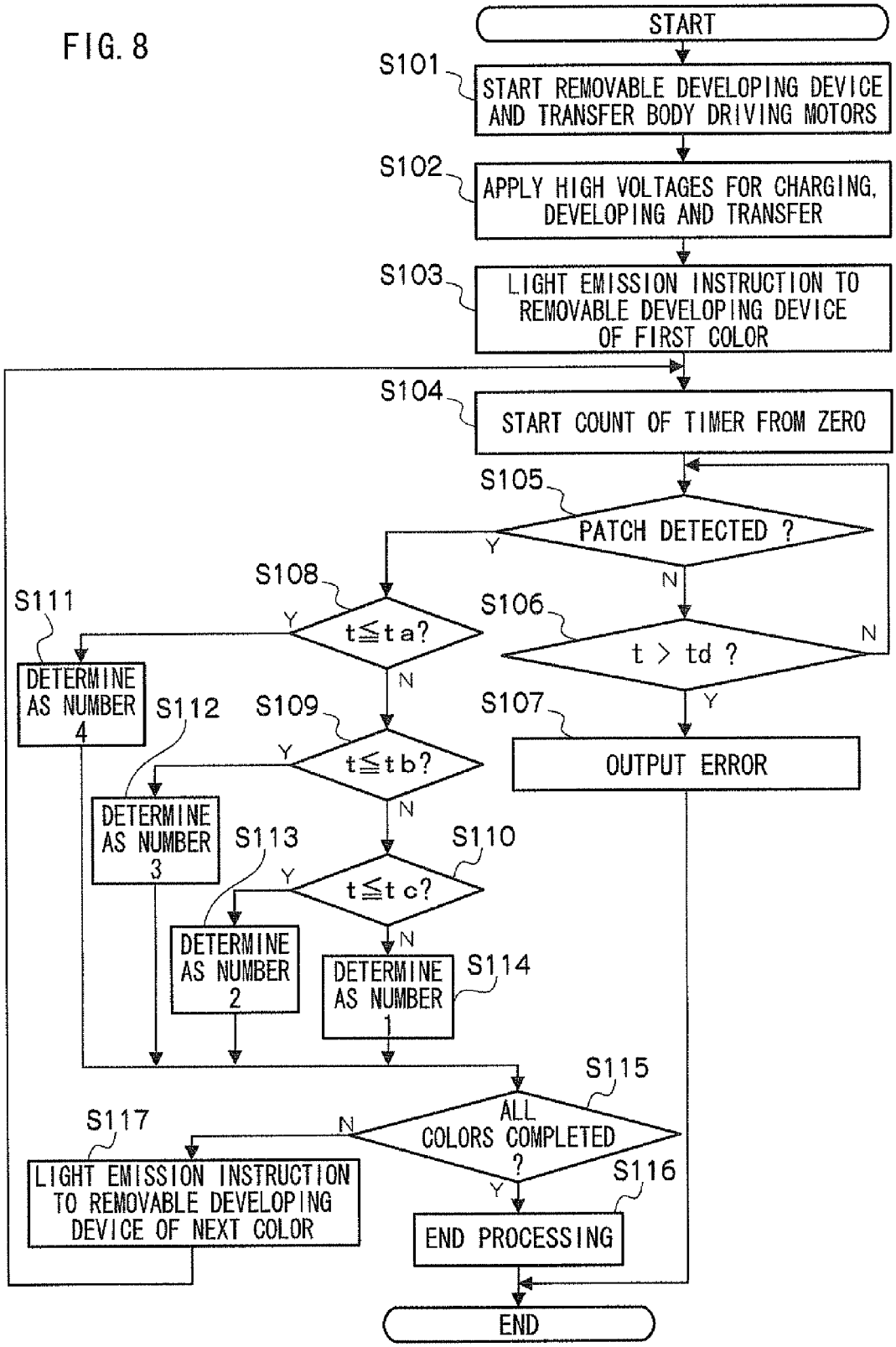
FIG. 8 is a flowchart illustrating a flow of identification processing.

A flow of identification processing at the MCU 32 is described using the flowchart of FIG. 8. In the flowchart of FIG. 8, for convenience, the position of the removable developing device 10A is represented by Number 1, the position of the removable developing device 10B is represented by Number 2, the position of the removable developing device 10C is represented by Number 3, and the position of the removable developing device 10D is represented by Number 4.

Firstly, in step 101, driving motors of the removable developing devices 10 and the transfer body 22 to start up. Then, in step 102, application of high voltages to the removable developing devices 10 for charging, development and transfer is instructed.

Then, in step 103, a light emission instruction is outputted for the removable developing device 10 of a first color. Herein, the term "first color" means a first color for the identification processing to identify the installation positions by the order of the colors, for example, when carrying out the identification processing with a sequence of the four colors CMYK, the first color is C.

After output of the light emission instruction, in step 104, the MCU 32 starts the count of a timer from zero. In step 105, the MCU 32 determines whether or not the patch has been detected by the patch detection sensor 24. If the patch has not been detected, in step 106, it is further determined whether or not the duration t has passed beyond td. If the determination in step 106 is positive, then in step 107 an error is outputted and the processing ends. Output of the error may be implemented by, for example, a user interface provided at the image forming device 20. If the determination of step 106 is negative, the processing returns back to step 105.

If the determination in step 105 is positive, then in step 108 it is determined whether or not t≤ta. If the determination of this step is positive, then in step 111, the removable developing device 10 of the color instructed by the light emission instruction is identified as being installed at the Number 4 position. Then the processing advances to step 115.

If the determination of step 108 is negative, then in step 109 it is determined whether or not t≤tb. If the determination of step 109 is positive, then in step 112 the removable developing device 10 of the color instructed by the light emission instruction is identified as being installed at the Number 3 position. Then the processing advances to step 115.

If the determination of step 109 is negative, then in step 110 it is determined whether or not t≤tc. If the determination of step 110 is positive, then in step 113, the removable developing device 10 of the color instructed by the light emission instruction is identified as being installed at the Number 2 position. Then the processing advances to step 115.

However, if the determination of step 110 is negative, then in step 114 the removable developing device 10 of the color instructed by the light emission instruction is identified as being installed at the Number 1 position. Then the processing advances to step 115.

In step 115, it is determined whether or not all colors have been completed. That is, in the present example, it is determined whether or not installation positions have been identified for the removable developing devices 10 corresponding to C, M, Y and K. If the determination of step 115 is positive, end processing (stopping the driving motors, ending the application of high voltages and the like) is carried out in step 116, and the identification processing ends.

On the other hand, if the determination of step 115 is negative, a light emission instruction for the removable developing device 10 of the next color is outputted in step 117, and the processing returns to step 104.

In the example described above, a light emission instruction for forming a patch of a single color is outputted. However, a light emission instruction for forming patches of two colors may be outputted.

More specifically, for example, by a light emission instruction for forming patches of the two colors C and M, C and M may be identified as a Number k and a Number m. Then, by a light emission instruction for forming patches of the two colors C and Y, the Number k or Number m and a Number n may be identified. Accordingly, Y may be identified as Number n. Further, at this time C is read at the timing of either number k or number m. If this is Number k, C may be identified as Number k, and thus M is number m. Thus, of Number 1 to Number 4, the colors at k, l and m may be identified, and the other position may be identified as K.

If a light emission instruction for forming patches of three colors is outputted, identification is possible by a method similar to the case of two colors. If a light emission instruction for forming patches of four colors (all colors) is outputted, identification is possible by combining this with light emission instructions for forming patches of three or fewer colors. In each case, identification is possible by image formation instructions for forming patches of at least one color of the colors that can be formed being outputted to the plural removable developing devices 10.

A lens may be provided at a light emission face of the LED 18. Specifically, this is described using FIG. 9.

Figure 9B:
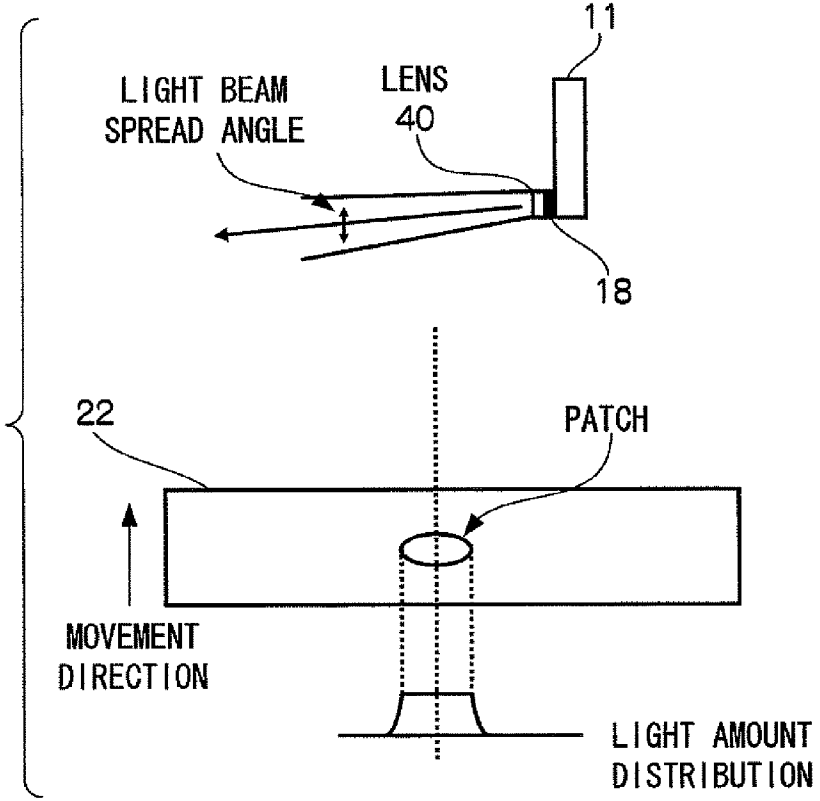
FIG. 9A and FIG. 9B are diagrams illustrating examples of patches in cases of providing a lens at an LED.
Figure 9A:
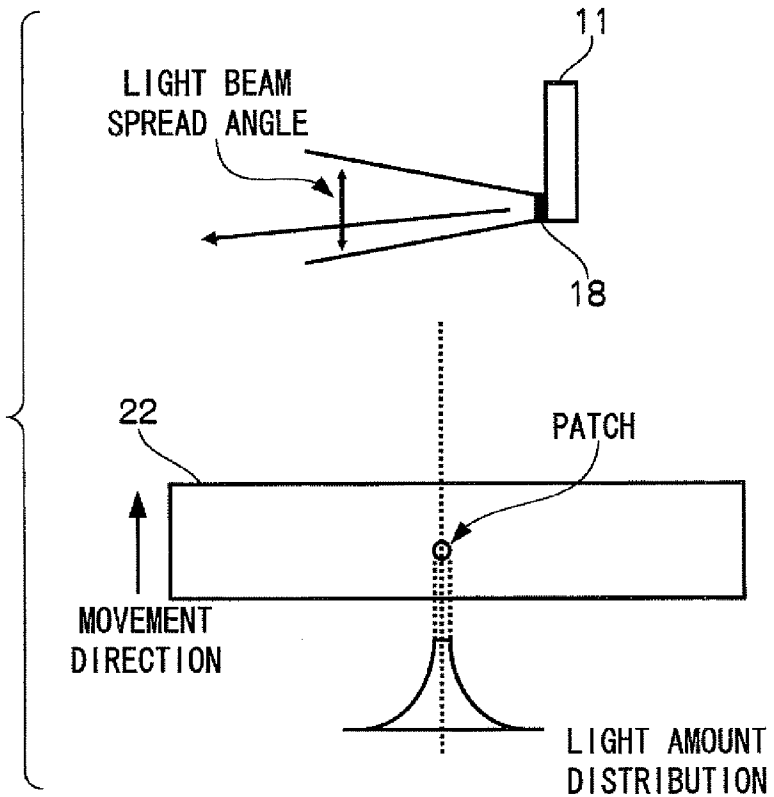

FIG. 9A and FIG. 9B are both diagrams showing an angle of beam spread of the light emitted by the LED 18 and a patch that is formed as a latent image by the emission of the LED 18. FIG. 9A shows the patch in a case in which no lens is provided, and FIG. 9B shows the patch in a case in which a lens 40 is provided.

As shown in FIG. 9B, the lens 40 is preferably a lens such that the beam spread angle in the direction of movement of the transfer body 22 is narrowed and the beam spread angle in a direction orthogonal to the movement direction is widened. That is, the lens 40 may be such that a patch is formed with a length of the patch in the direction orthogonal to the movement direction of the transfer body 22 being longer than a length of the patch in the movement direction of the transfer body 22.

Further, although the LED 18 described above is provided at the tag 11, the LED 18 may be provided separately from the tag 11. This is specifically described using FIG. 10A to FIG. 10C.

Figure 10A:
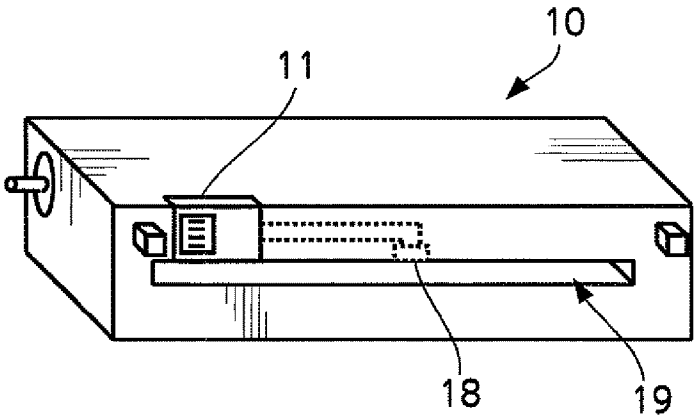
FIG. 10A to FIG. 10C are diagrams illustrating a mounting example and a tag contact terminal example in a case in which the LED is provided separately from the tag.
Figure 10C:
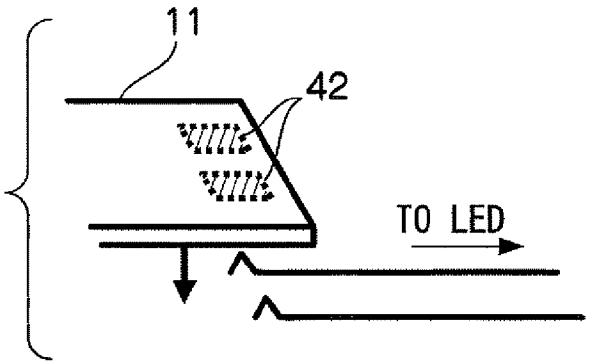
Figure 10B:
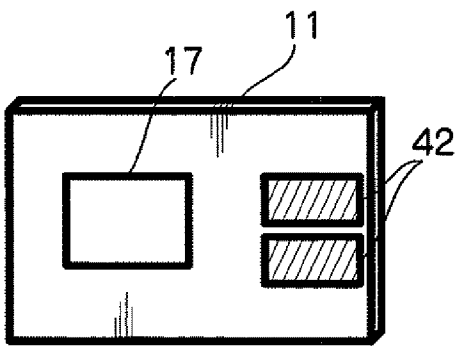

FIG. 10A is a perspective view of the removable developing device 10 in a case in which the LED 18 is provided separately. FIG. 10B is a perspective view of the tag 11 in this case. FIG. 10C is a diagram showing an example of electrical connection between the tag 11 and the LED 18.

Providing the LED 18 separately raises a degree of freedom in positions of mounting of the tag 11 and the LED 18. For example, a mounting position as illustrated in FIG. 10A is for a case in which the position detectable by the patch detection sensor 24 is at the middle of the transfer body 22 but the removable developing device 10 has a structure in which the tag 11 is not mounted at the middle.

In this case, for example, LED terminals 42 may be configured as contact terminals as illustrated in FIG. 10B and the tag 11 may be pushed against and make contact with the wiring of the LED 18.

The flow of processing of the flowchart described above is an example. Clearly, the processing sequence may be rearranged, new steps may be added and unnecessary steps may be removed within a technical scope not departing from the spirit of the present invention.

Moreover, the transfer body 22 may be a body that transfers developing agent and then transfers the developing agent to a recording medium, or may be a body that conveys a recording medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a plurality of removable image formation sections, each removable image formation section capable of forming images of a pre-specified color, each removable image formation section including:

a memory that stores a color information representing the pre-specified color of images that are formable by the removable image forming section;

an image-bearing body;

a charging section that charges the image-bearing body to a pre-specified potential;

a first exposure section that performs exposure onto the image-bearing body and forms an electrostatic latent image representing an identification image on the image-bearing body, the first exposure section being within the removable image formation section;

a developing section that develops the electrostatic latent image; and a control section that controls the first exposure section to form the identification image in accordance with an image formation instruction, the image formation instruction instructing that the identification image be formed of a color represented by the color information;

the image forming device further comprising:

a second exposure section externals to the plurality of removable image formation sections that performs exposure onto the image-bearing body of each removable image formation section and causes an electrostatic latent image representing an image to be on formed on each image-bearing body;

a transfer body upon which an image is formed by the plurality of removable image formation sections;

a reading section that reads the identification images; and an identification section that outputs to the plurality of removable image formation sections the image formation instruction instructing formation of the identification image of at least one color of the colors formable by the plurality of removable image formation sections and that, on the basis of a duration from the output of the image formation instruction until the identification image is read by the reading section, determines a position at which each removable image formation section of the plurality of removable image formation sections is located and identifies an order of the plurality of removable image formation sections.

2. The image forming device according to claim 1, further comprising a lens provided at a light emission face of each of the first exposure sections in order to make a length of the identification image in a direction orthogonal to a direction of movement of the transfer body longer than a length of the identification image in the direction of movement of the transfer body.

3. The image forming device according to claim 1, wherein, when the color represented by the image formation instruction instructing formation of the identification image is the same as the color represented by the color information stored in the memory, the developing section forms the identification image.

4. The image forming device according to claim 1, wherein the reading section, that reads the identification images formed on the transfer body, reads the identification image formed at the middle of the transfer body.

5. The image forming device according to claim 1, wherein the first exposure section is configured by a single LED.

6. A method for identifying positions of removable image formation sections in an image forming device that includes:

a plurality of the removable image formation sections, each removable image formation section capable of forming images of a pre-specified color, each removable image formation section including, a memory that stores color information representing the pre-specified color of images that are formable by the removable image formation section, an image-bearing body, a charging section that charges the image-bearing body to a pre-specified potential, a first exposure section that performs exposure onto the image-bearing body and forms an electrostatic latent image representing an identification image on the image-bearing body, the first exposure section being within the removable image formation section, a developing section that develops the electrostatic latent image, and a control section that controls the first exposure section to form the identification image in accordance with an image formation instruction, the image formation instruction instructing that the identification image be formed of a color represented by the color information, a second exposure section external to the plurality of removable image formation sections that performs exposure onto the image-bearing body of each removable image formation section and causes electrostatic latent image representing an image to be formed on each image-bearing body, a transfer body upon which an image is formed by the plurality of removable image formation sections, a reading section that reads the identification images, and an identification section that identifies an order of the plurality of removable image formation sections, the method comprising:

outputting to the plurality of removable image formation sections the image formation instruction instructing formation of the identification image of at least one color of the colors formable by the plurality of removable image formation sections;

measuring a duration from outputting the image formation instruction until the identification image is read by the reading section; and on the basis of the measured duration, determining a position at which each removable image formation section of the plurality of removable image formation sections is located and identifying an order of the plurality of removable image formation sections.

7. The method for identifying positions of removable image formation sections in an image forming device according to claim 6, wherein the developing section forms the identification image when the color represented by the image formation instructions instructing formation of the identification image is the same as the color represented by the color information stored in the memory.

8. The method for identifying positions of removable image formations in an image forming device according to claim 6, wherein the reading section, that reads the identification images formed on the transfer body, reads the identification image formed at the middle of the transfer body.

9. The method for identifying positions of removable image formations in an image forming device according to claim 6, wherein the first exposure section is configured by a single LED.

* * * * *